US008096890B2

(12) United States Patent
Anderson et al.

(10) Patent No.: US 8,096,890 B2
(45) Date of Patent: Jan. 17, 2012

(54) AMUSEMENT RIDE ASSEMBLY AND METHOD

(75) Inventors: Keith Randal Anderson, Nelson (NZ); Arthur Tyndall, Christchurch (NZ)

(73) Assignees: Keith Randal Anderson, Nelson (NZ); Jillyan Olive Peterson, Nelson (NZ)

( * ) Notice: Subject to any disclaimer, the term of this patent is extended or adjusted under 35 U.S.C. 154(b) by 753 days.

(21) Appl. No.: 10/541,649

(22) PCT Filed: Jan. 7, 2004

(86) PCT No.: PCT/NZ2004/000003

§ 371 (c)(1),
(2), (4) Date: Apr. 18, 2006

(87) PCT Pub. No.: WO2004/060513

PCT Pub. Date: Jul. 22, 2004

(65) Prior Publication Data

US 2006/0252562 A1 Nov. 9, 2006

(30) Foreign Application Priority Data

Jan. 7, 2003 (NZ) ..... 523504

(51) Int. Cl.
*A63G 21/06* (2006.01)

(52) U.S. Cl. ..... 472/36

(58) Field of Classification Search ..... 472/36
See application file for complete search history.

(56) References Cited

U.S. PATENT DOCUMENTS

| | | | | | |
|---|---|---|---|---|---|
| 3,854,554 | A | * | 12/1974 | Booker, Jr. | 187/382 |
| 4,003,314 | A | * | 1/1977 | Pearson | 104/307 |
| 4,049,999 | A | * | 9/1977 | Thibaudon | 388/816 |
| 4,187,784 | A | * | 2/1980 | Fernandez et al. | 104/235 |
| 4,563,955 | A | * | 1/1986 | Tarassoff | 104/168 |
| 4,627,361 | A | * | 12/1986 | Tarassoff | 104/28 |
| 4,669,389 | A | * | 6/1987 | Tarassoff | 104/173.2 |
| 4,712,486 | A | * | 12/1987 | Tarassoff | 104/173.1 |
| 4,926,754 | A | | 5/1990 | Feuz | |
| 4,934,277 | A | | 6/1990 | Smith et al. | |
| 5,121,695 | A | * | 6/1992 | Feuz | 104/178 |
| 5,224,425 | A | * | 7/1993 | Remington | 104/53 |
| 5,515,789 | A | | 5/1996 | Brochand et al. | |
| 5,759,107 | A | * | 6/1998 | Nagel | 472/47 |
| 5,931,416 | A | * | 8/1999 | Carpenter | 244/155 A |
| 6,431,080 | B1 | * | 8/2002 | Eisendle et al. | 104/178 |
| 6,443,847 | B1 | | 9/2002 | Van Asch et al. | |
| 6,513,440 | B1 | * | 2/2003 | Huard et al. | 104/27 |
| 2002/0162477 | A1 | * | 11/2002 | Palumbo | 104/87 |

FOREIGN PATENT DOCUMENTS

| | | | |
|---|---|---|---|
| CH | 598039 | | 4/1978 |
| EP | 0491632 | | 2/1996 |
| JP | 11226266 | | 8/1999 |
| JP | 2001191916 | | 7/2001 |
| WO | PCT/NZ99/00100 | * | 1/2000 |

* cited by examiner

*Primary Examiner* — Gene Kim
*Assistant Examiner* — Amir Klayman
(74) *Attorney, Agent, or Firm* — Dann, Dorfman, Herrell and Skillman, P.C.

(57) ABSTRACT

An amusement ride assembly includes a rotatable endless loop cable spanning between end stations and a drive system operable to rotate the loop cable. A passenger carrier is suspended from the cable and includes a roller mechanism to enable the passenger carrier to free-roll along the cable and an associated clamping mechanism to alternatively fix the passenger carrier to the cable. A control system may control the drive system and to enable actuation of the clamping mechanism to fix the passenger carrier to the cable when the carrier is at a position along the cable remote from the end stations.

23 Claims, 11 Drawing Sheets

AMUSEMENT RIDE ASSEMBLY AND METHOD

FIELD OF THE INVENTION

The present invention relates to an amusement ride assembly and method for passengers. In particular, although not exclusively, the invention may be employed for recreational purposes to provide an adrenalin ride.

BACKGROUND TO THE INVENTION

Various aerial cableway systems are known for transporting passengers and/or goods along long mountain terrains, over canyons and rivers, and through other areas where no runways, railways or similar structures can or may be constructed.

In one form of cableway system a fixed cable is suspended between two or more stationary towers or stations, and one or more vehicles, such as carriages, cabs, or cars, which travel along the cable via a roller suspension system. In a chair lift a system a cable is driven by pulleys or bull wheels in end towers or stations and moves chairs carried by the cable between the towers and stations. The individual chairs are fixedly attached to and suspended from the moving traction cable.

Recreational, adventure, and amusement rides utilising an aerial cableway system, such as flying foxes, are known. Typically, these rides depend for popularity upon a lengthy duration of brisk acceleration which quite often involves moving a passenger through bends and the like.

It is an object of the present invention to provide an alternative amusement ride assembly which at least provides a useful alternative.

SUMMARY OF THE INVENTION

In accordance with an aspect of the present invention, there is provided an amusement ride assembly including: a rotatable endless loop cable spanning between end stations; a drive system operable to rotate the loop cable; and a passenger carrier suspended from the cable, including a roller mechanism to enable the passenger carrier to free-roll along the cable and an associated clamping mechanism to alternatively fix the passenger carrier to the cable.

In accordance with a further aspect of the present invention, there is provided a method of providing an amusement ride including the steps of: loading a passenger carrier with one or more passengers; allowing the passenger carrier to free-roll under gravity along a span of a loop cable from a position at or toward one station, toward another station; clamping the passenger carrier to the loop cable at a specific point intermediate of the distance between the two stations; and rotating the loop cable to move the passenger carrier further between the stations.

In accordance with a further aspect of the present invention, there is provided an amusement ride assembly including a cascade of two or more stages, each stage including: a rotatable endless loop cable spanning between two stations; and a drive system operable to rotate the loop cable, the ride further including: one or more passenger carriers, which can accommodate one or more passengers, attachable to the loop cables of each stage and a suspension member which suspends the passenger carrier(s) to the loop cables, wherein the suspension member includes a roller mechanism to enable the passenger carrier(s) to free-roll along the loop cables and a clamping mechanism which can be actuated to alternatively fix the passenger carrier(s) to the loop cables.

In accordance with a further aspect of the present invention, there is provided an amusement ride assembly including: a rotatable endless loop cable spanning between end stations; a drive system operable to rotate the loop cable; a passenger carrier suspended from the cable, including a roller mechanism to enable the passenger carrier to free-roll along the cable and an associated clamping mechanism to alternatively fix the passenger carrier to the cable; and a control system arranged to allow the passenger carrier to free-roll part way along the cable after initial release of the passenger carrier at the commencement of a ride and to then actuate the clamping mechanism to fix the passenger carrier to the loop cable when the passenger carrier has slowed down to less than a predetermined speed.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples only.

BRIEF DESCRIPTION OF THE DRAWINGS

Preferred embodiments of the invention are described with reference to the drawings and by way of example only, wherein.

DETAILED DESCRIPTION OF PREFERRED EMBODIMENTS

Figure 1:
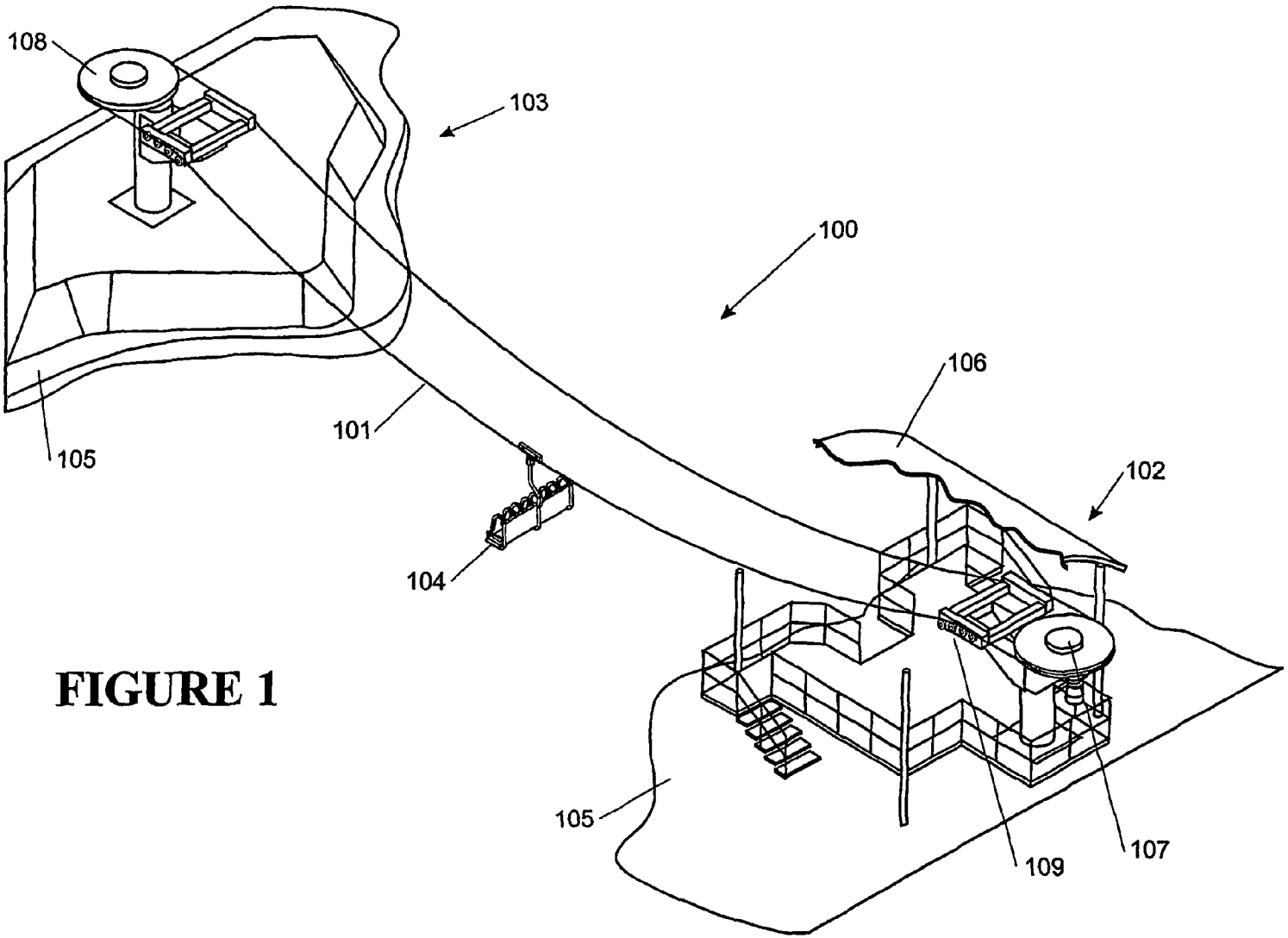
FIG. 1, shows a perspective view of the preferred embodiment amusement ride assembly, including a loop cable spanning between two stations and a passenger carrier which travels on the cable.

Referring to FIG. 1, the preferred embodiment amusement ride assembly 100 is used to provide an adventure or recreational ride for one or more passengers across a scenic valley or gorge.

The amusement ride assembly 100 includes a rotatable endless loop cable 101 suspended across a valley between two stations 102, 103. The ride assembly 100 includes a passenger carrier 104 suspended from the cable 101 which transports one or more passengers back and forth across the valley as it rides on the cable 101. The passenger carrier 104 includes a roller mechanism to enable the passenger carrier 104 to free-roll along the cable 101 and a clamping mechanism which is actuable to fix the passenger carrier 104 to the cable 101. The roller and clamping mechanisms will be explained in more detail below.

Once loaded with one or more passengers, the passenger carrier 104 can be released from a station so that it free-rolls along the cable 101 under the influence of gravity via the roller mechanism of the passenger carrier 104, thereby providing an accelerating adrenalin ride for the passengers. Once the passenger carrier 104 comes to rest, or at some other point during the ride, the clamping mechanism of the passenger carrier 104 can be actuated to fix the passenger carrier 104 to the cable 101 which can be rotated appropriately to return the passenger carrier 104 to either station 102, 103.

In the preferred embodiment, the stations 102, 103 form anchor towers which are built into rock 105 or similar for support and are spaced apart, by for example 1 to 3 km. One station is the drive tower 102 where passengers are loaded and unloaded onto the passenger carrier 104 when it is docked. Typically, the drive tower 102 is provided with a canopy 106 to shelter people and equipment from the weather. The drive tower 102 also drives the rotation of the cable 101. The other station is the return tower 103.

The cable 101, which may be a 28 mm diameter steel cable for example, is suspended between the towers 102, 103 by a drive system which is also operable to rotate the cable 101. In the preferred embodiment the cable 101 takes up shape which limits the cable tension under operating loads to approximately 0.1 times the ultimate strength of the cable 101, to provide a factor of safety of 10. The drive system consists of two 4 m diameter bull wheels 107, 108, one located at each of the towers 102, 103, about which the cable 101 passes.

The bull wheel 107 of the drive tower 102 is coupled via a gearbox to a 30 kW electric brake motor and a second 11 kW electric motor is coupled to the gearbox to provide an emergency back-up drive. The 30 kW electric drive system is operable to rotate the cable 101 either clockwise or anticlockwise about the bull wheels 107,108 at variable speeds. Two generators, one of 80 kW capacity and one of 30 kW capacity, are provided to supply power to the drive system. The 80 kW generator is the primary power source, while the 30 kW generator is used to provide power to the 11 kW back-up drive motor.

The bull wheel 107 of the drive tower 102 is fitted with a concentric braking ring onto which a hydraulically released scissor brake mechanism operates. If there is a failure in the hydraulics or power generators, an emergency brake will be initiated.

In the preferred embodiment, the towers 102, 103 are approximately level in elevation, and the tension on the suspended cable 101 ensures that the cable 101 has an arc or catenary so that the passenger carrier 104 can free-roll back and forth along the cable 101 under the influence of gravity. Generally, the passenger carrier 104 may attain speeds of up to 100 kph as it free-rolls along the cable 101 through the 100 m catenary of the cable 101, although the speed will ultimately depend on the loading of the passenger carrier 104. Further, because the towers 102, 103 are approximately level in elevation, it is impossible for the free-rolling passenger carrier 104 to crash into either tower 102,103 after being released. It will however be appreciated that the elevation of the towers 102,103 with respect to each other could be varied to provide different ride speeds.

The drive system includes a cable 101 tensioning system, for example powered by hydraulics or the like, which is arranged to move one or both of the bull wheels 107,108 radially either towards or away from the other (i.e. longitudinally) to enable the slack and ultimately the arc of the cable 101 to be adjusted according to the various operational and safety requirements of the ride assembly 100. For example, the arc of the cable 101 may be adjusted in accordance with the load of the passenger carrier 104, wind, expansion and contraction cable weather characteristics, or to provide different speed rides.

Figure 1A:
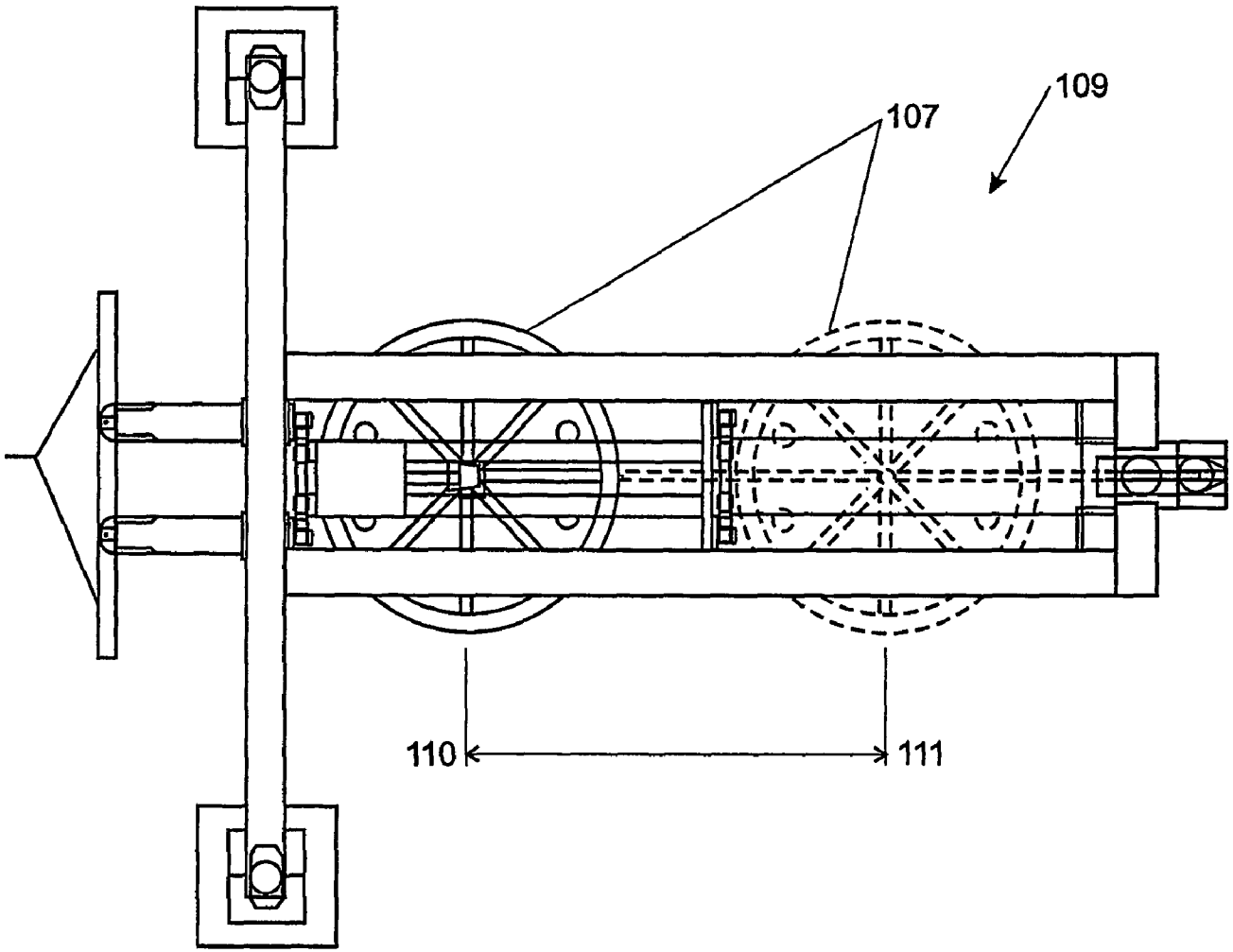
FIG. 1*a* shows a plan view of a portion of a drive tower of the amusement ride assembly, including a portion of a cable tensioning system.
Figure 1B:
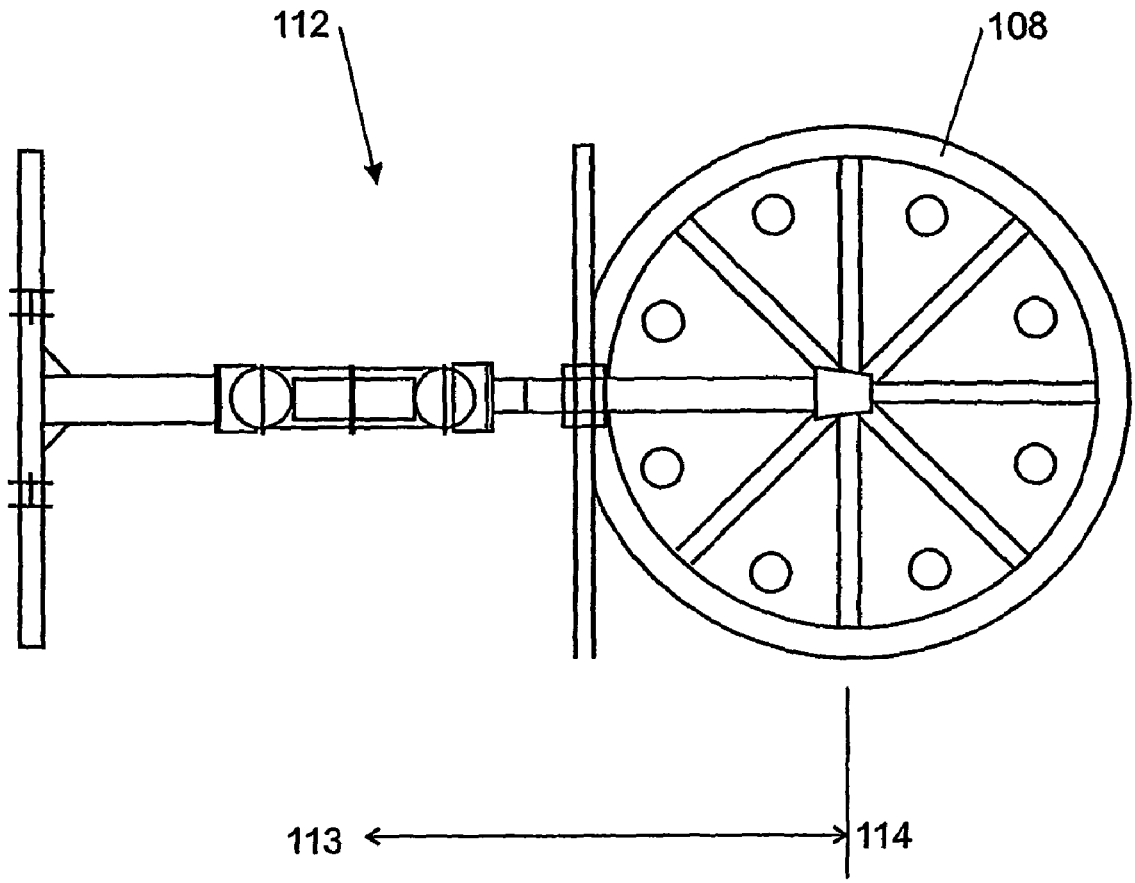
FIG. 1*b* shows a plan view of a portion of a return tower of the amusement ride assembly, including a another portion of the cable tensioning system.

Referring to FIG. 1*a*, the portion of the tensioning system 109 associated with bull wheel 107 of the drive tower 102 is shown. The tensioning system 109 is powered by hydraulics which can move the bull wheel 107 longitudinally, for example by up to 5 m, between points 110 and 111. As mentioned, this enables the slack, and ultimately the arc of the cable 101 to be adjusted in accordance with various operating and weather factors. Similarly, referring to FIG. 1*b*, the remainder of the tensioning system 112 associated with the bull wheel 108 of the return tower 103 is shown. This too is hydraulically powered and is operable to move the bull wheel 108 longitudinally between points 113, 114. It will be appreciated that the tension of the cable 101 could be adjusted by movement of either or both bull wheels 107,108.

Typically, the towers 102,103 and the drive system will sustain loads such as 13 tonne per cable length and a 26 tonne load of the bull wheels 107,108 and foundations. The cable tensions are typically maintained at 13 tonne maximum with the bull wheels 107,108 being longitudinally moveable by up to about 5 meters via the hydraulic tensioning mechanism(s) 109,112. This allows the cable 101 to take up a shape consistent with the 13 tonne load and the passenger carrier 104 load.

Figure 2:
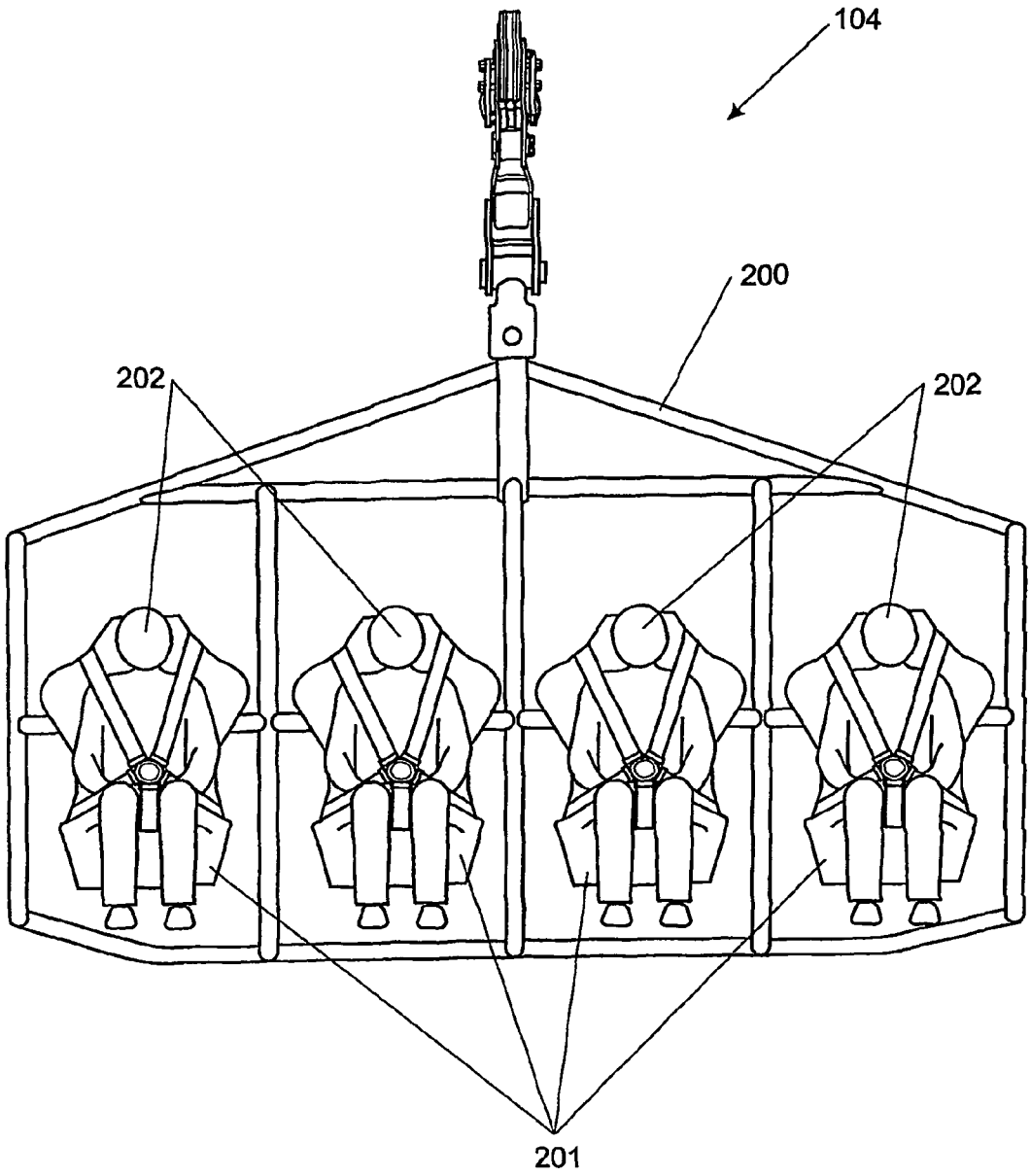
FIG. 2 shows a front elevation view of the preferred embodiment passenger carrier loaded with passengers.

Referring to FIG. 2, the passenger carrier 104 includes a base framework 200 and one or more passenger seats 201, each of which accommodates a passenger 202, mounted to or integrally formed with the base framework 200. In the preferred embodiment the passenger carrier unloaded weighs 500 kg, with a maximum loaded weight of 1000 kg. The passenger seats 201, which may be rally car seats or the like, include safety harnesses such as 5-point seatbelt restraints and/or an interlocking restraint in the form of a coil which wraps around seated passengers 202 to secure them in their seats. The interlocking restraint is preferably locked externally in a location which seated passengers cannot access for safety. The passenger carrier may also be fitted with cushioning or padding on surfaces which a passenger may come into contact with during the ride in normal operation.

Figure 3:
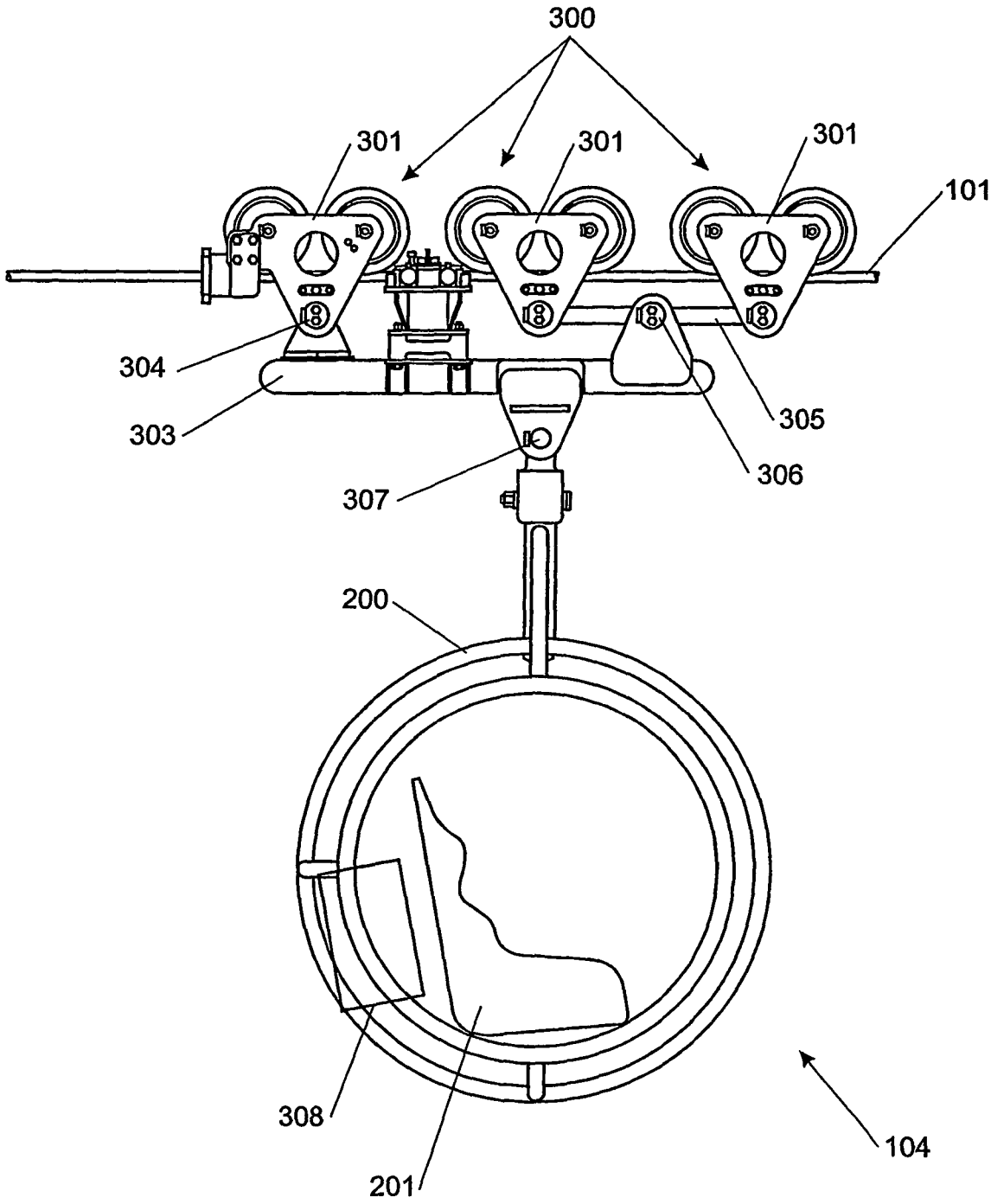
FIG. 3 shows a side elevation view of the passenger carrier of FIG. 2 suspended from a cable without passengers.

Referring to FIG. 3, the passenger carrier 104 is suspended from the cable 101 by a roller mechanism which is arranged to allow the passenger carrier 104 to free-roll along the cable 101. The roller mechanism typically includes three pairs of roller wheels 300 which roll along the cable 101. Each pair of roller wheels 300 are coupled by two substantially triangular side plates 301 and each wheel of the pair is rotatably connected between the plates 301 at points above the cable 101. The triangular side plates 301 of the rear pair of roller wheels 300 is pivotally connected below the cable 101 to a horizontal support member 303 at point 304, while the triangular side plates 301 of the two front pairs of roller wheels 300 are coupled to each other by a horizontal pivot member 305. The horizontal pivot member 305 is in turn pivotally connected at point 306 to the horizontal support member 303. The base frame 200 of the passenger carrier 104 is pivotally connected at point 307 to the horizontal support member 303. The pivoting arrangement at points 304, 306, and 307 enable the passenger carrier 104 to pivot appropriately while riding on the cable 101 in accordance with the arc of the cable or due to other forces.

Figure 4:
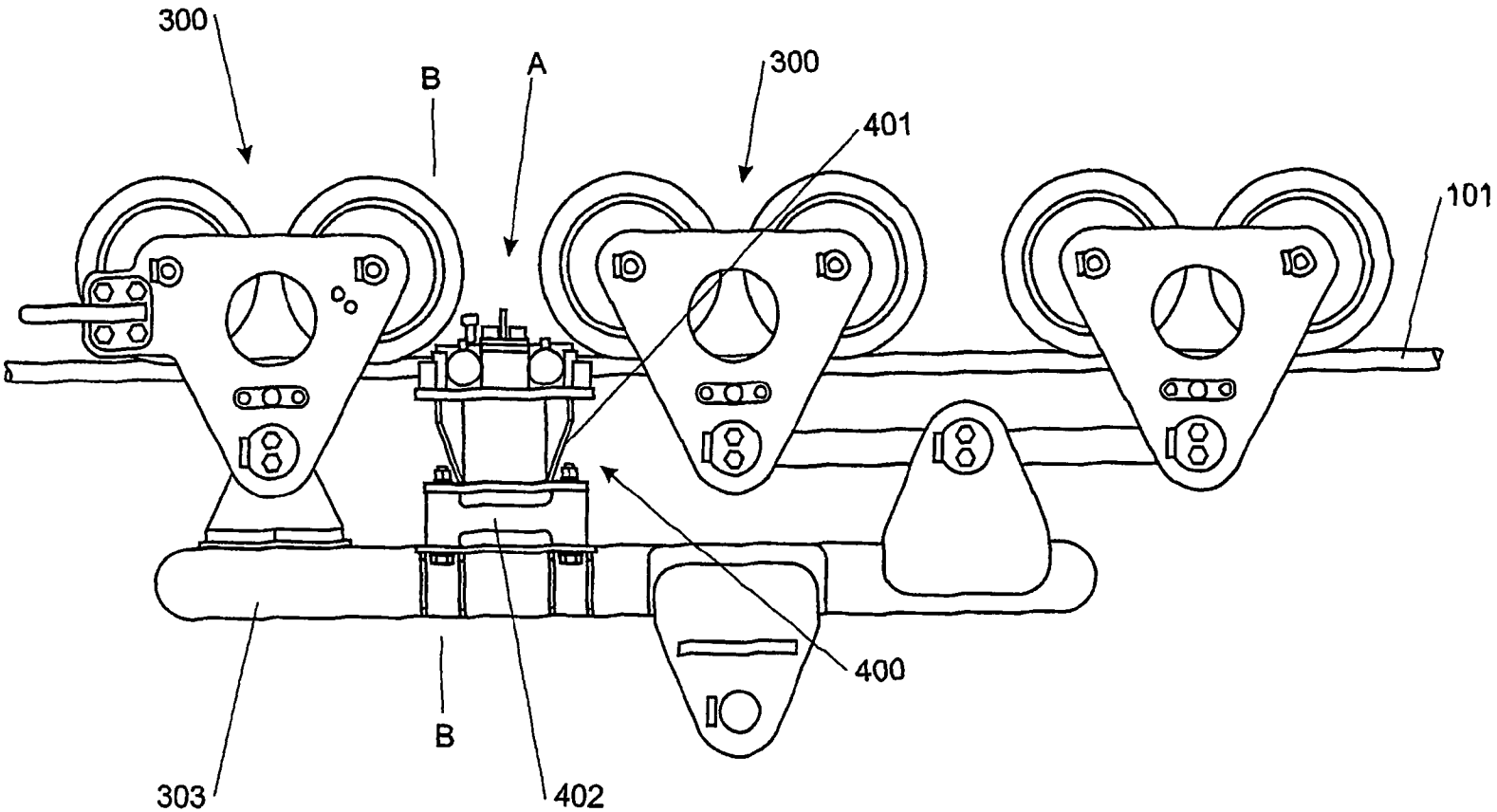
FIG. 4 shows a side elevation view of a roller mechanism and a clamping mechanism of the passenger carrier.

Referring to FIG. 4, the passenger carrier 104 includes a clamping mechanism, generally indicated by 400, which is attached to the horizontal support member 303 between the two rear pairs of roller wheels 300. The clamping mechanism 400 includes a base 401 which is mounted above the horizontal support member 303 by spacer blocks 402. The clamping mechanism 400 is arranged to receive the cable 101 above the base 401 and may be actuated to fix the passenger carrier 104 to the cable 101. In the preferred embodiment, the clamping mechanism 400 is hydraulically powered.

Figure 5:
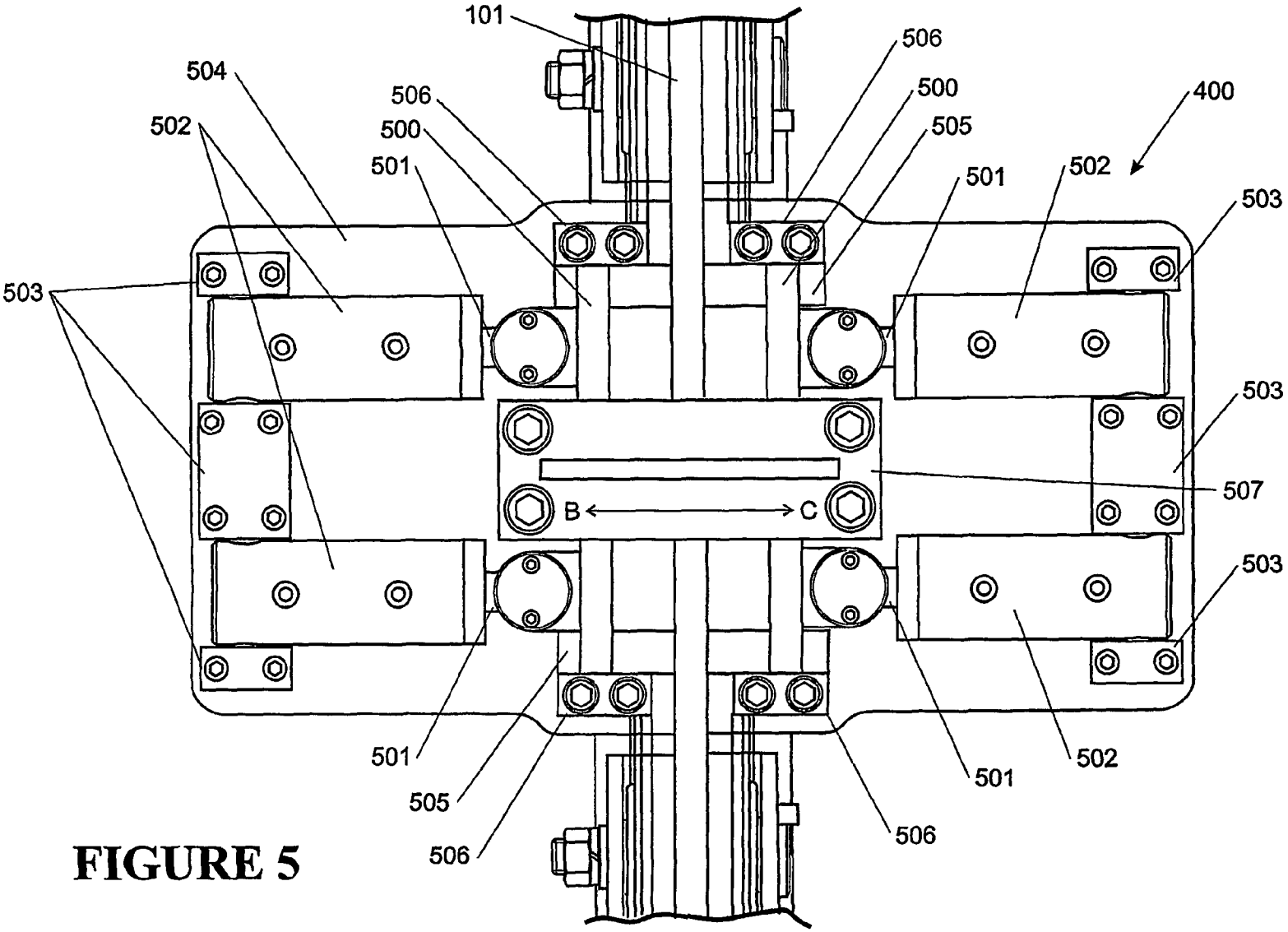
FIG. 5 shows a plan view of the clamping mechanism of the passenger carrier from direction A of FIG. 4.

Referring to FIG. 5, the clamping mechanism 400 includes two rope clamp blocks 500 on each side of the cable 101 which may move back and forth toward or away from each other, as indicated by arrows B and C, to open and close the clamp respectively. When the clamping mechanism 400 is actuated to close the clamp, the rope clamp blocks 500 are moved together toward the cable 101 until they securely clamp the cable 101. To then open the clamp to release the cable 101, the rope clamp blocks are moved away from the cable 101 and each other.

Each rope clamp block 500 is coupled to two piston rods 501 which are arranged to move back and forth within double acting hydraulic cylinders 502. The hydraulic cylinders 502 are coupled to cylinder mounting blocks 503 which are connected to the top plate 504 of the base 401 of the clamping mechanism 400. The top plate 504 is also provided with plastic bearing strips 505 along which the rope clamp blocks 500 may slide. Adjacent the plastic bearing strips 505 are end guide blocks 506 mounted on the top plate 504 which guide the cable 101 between the rope clamp blocks 500. A clamp bridge block 507, mounted at each end to the top plate 504 by bridge blocks (not shown), is also provided above the cable 101 and rope clamp blocks 500 to guide the cable 101.

Figure 6:
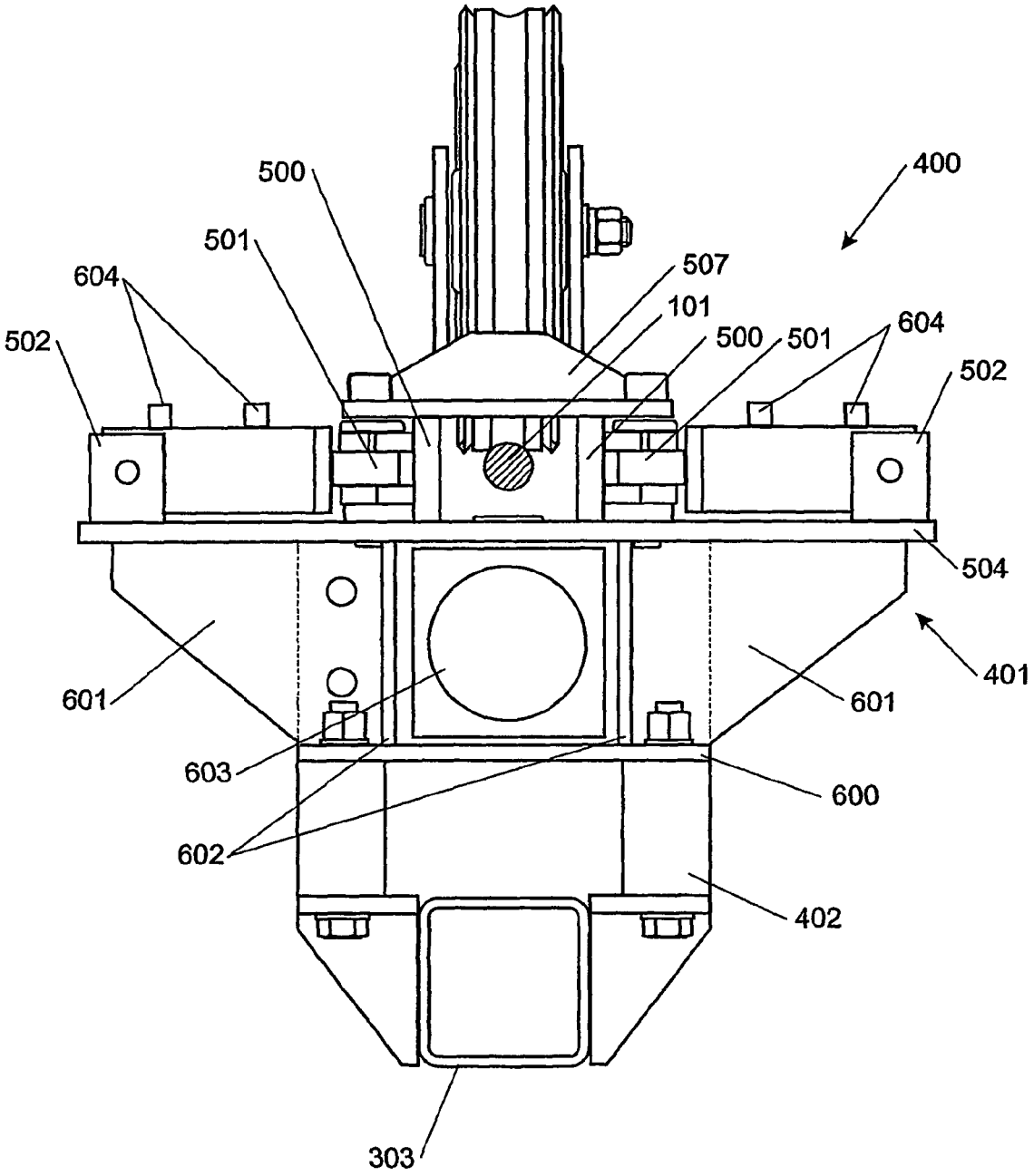
FIG. 6 shows a rear end cross-sectional view of the clamping mechanism of the passenger carrier through line B of FIG. 4.

Referring to FIG. 6, the top plate 504 of the base 401 is connected to a bottom plate 600 via side support webs 601 and side plates 602. A hydraulic pump unit 603 is mounted within the base between the top 504, bottom 600 and side 602 plates. The hydraulic pump unit 603 is connected via hydraulic tubes (not shown) to the fluid inlet/outlet ports 604 of the hydraulic cylinders 502 and is operable to open and close the rope clamp blocks 500 as desired by causing the piston rods 501 to move appropriately.

Figure 7:
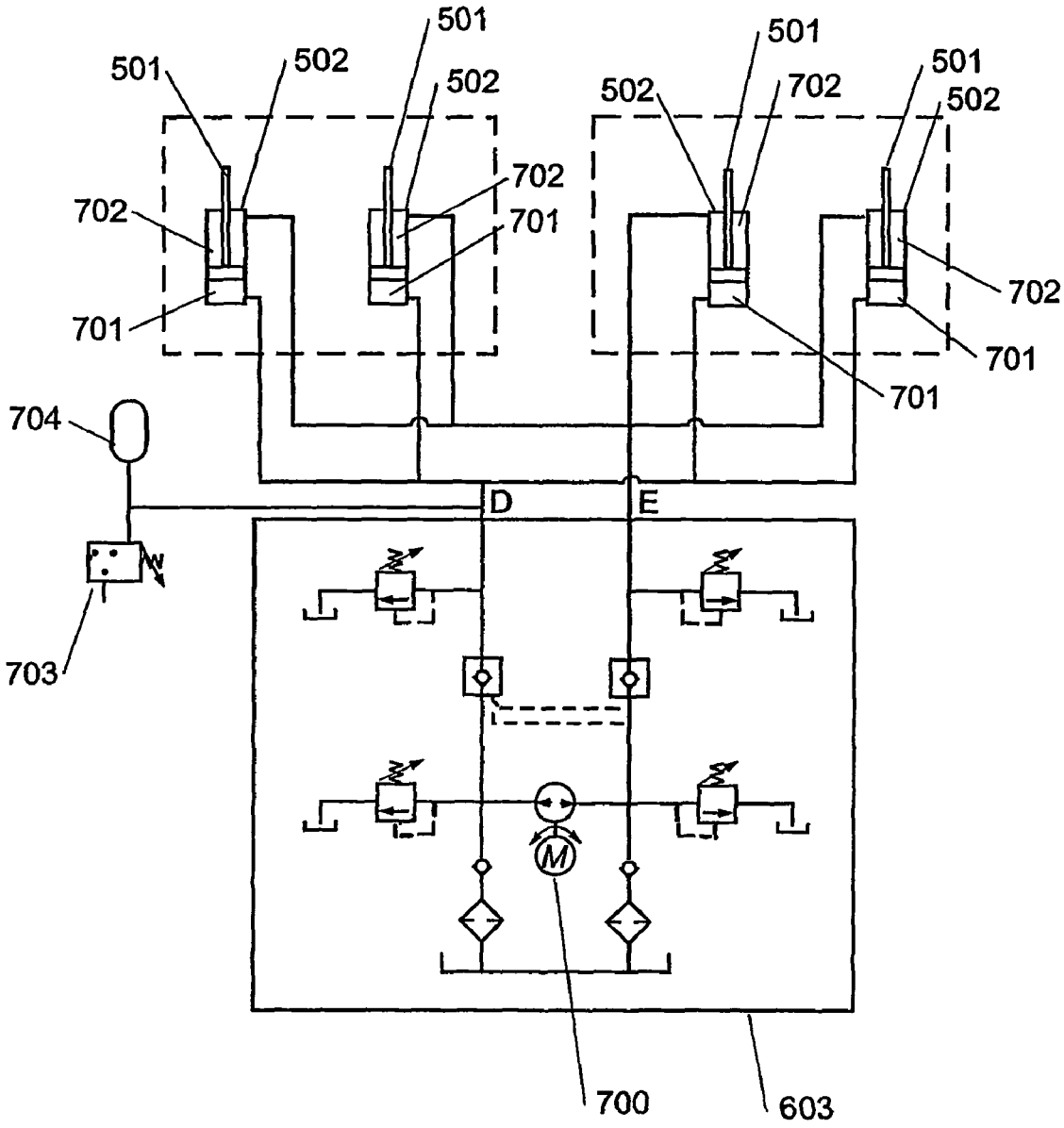
FIG. 7 shows a hydraulic circuit diagram of the preferred hydraulic system which actuates the clamping mechanism of the passenger carrier.

Referring to FIG. 7, the operation of the clamping mechanism 400 will be described in more detail. When the clamp is to be closed a control signal is sent to the hydraulic pump unit 603 to start an electric motor 700 to pump fluid from a self-contained reservoir within the hydraulic pump 603, via fluid line D, into chambers 701 of the hydraulic cylinders 502. As the chambers 701 pressurise, the piston rods 501 move out of the cylinders 502 to close the rope clamp blocks 500 on the cable 101 to prevent relative movement between the passenger carrier 104 and the cable 101. During this process the fluid in chambers 702 of the cylinders 502 is forced into the hydraulic pump unit 603 via fluid line E. Once the desired pressure is reached, for example 1500 psi (10342 KPa), an electrical signal is sent from a pressure switch 703 to turn off the electric motor 700. An accumulator 704 is connected to fluid line D to maintain a constant minimum pressure within the line, for example 1000 psi (6895 KPa).

When the clamp is to be opened, a control signal is sent to the hydraulic pump unit 603 to start the electric motor 700 in the reverse direction to pump fluid into chambers 702 of the cylinders 502 via fluid line E for a set period of time, for example 3 seconds. As chambers 702 pressurise, the piston rods 501 withdraw into the cylinders 502 thereby opening the clamp by moving the rope clamp blocks 500 away from the cable 101. At the end of the 3 seconds the electric motor 700 of the hydraulic pump unit is turned off.

The amusement ride assembly 100 may include an electronic and/or computer based control system, for example comprising a number of programmable logic controllers (PLCs), which controls the operation of the drive system, tensioning system, and the clamping mechanism 400 of the passenger carrier 104 in accordance with the type of ride to be provided. The control system may include one or more control modules which communicate via a radio link. In the preferred embodiment, the control system includes station control modules located at the drive 102 and return 103 towers which control the drive system and tensioning system. For example, the drive station control module may control the speed and direction at which the cable 101 rotates. The station control modules also include scanning proximity sensors which determine the distance of the passenger carrier 104 from either of the towers 102, 103. It will be appreciated that the control modules may be located in a remote location distinct from either of the towers 102,103 also.

In the preferred embodiment, the control system also includes a passenger carrier control module located on the passenger carrier 104. Reverting to FIG. 3, the passenger carrier control module may include a control box 308 mounted behind the passenger seats 201 of the passenger carrier 104. The control box 308 includes a radio receiver/transmitter, two-way communication intercom, rechargeable battery power supply, and other electronic control circuitry. The control box 308 powers the clamping mechanism 400 and in particular sends control signals to the hydraulic pump unit 603 to open and close the clamp.

The passenger carrier control module also preferably includes a number of sensors. First, proximity sensors are provided which determine the distance of the passenger carrier 104 from either of the towers 102, 103. Secondly, a distance measurement device associated with one pair of roller wheels 301 is provided to determine the distance traveled by the passenger carrier 104 along the cable 101. Thirdly, a speedometer associated with roller mechanism is provided which determines the speed of the passenger carrier 104 as it travels along the cable 101. Finally, clamp sensors associated with the clamping mechanism 400 are provided which indicate whether the clamp is fully open or closed. One or more of the above types of sensors could be provided. The passenger carrier 104 may also be provided with a control panel which displays the output of various sensors, for example speed and the status of the clamp. For safety, the control panel may also include a switch, button, or the like to enable manual actuation of the clamping mechanism 400 by a passenger.

The station control modules communicate via radio link with the passenger carrier control module. For example, the passenger carrier control module may send data to the station control modules containing the output from its various sensors, for example speed, distance traveled, clamp status, proximity sensor output etc. The station control module may then compare the passenger carrier data with the output from its own sensors and send control signals back to the passenger carrier control module to control the actuation of the clamping mechanism 400 as desired.

The control system may operate in an automatic mode or a manual mode. While in automatic mode, the control system operates the drive system, tensioning system, and clamping mechanism in accordance with preset programming to provide a particular ride. If however a fault is detected while in automatic mode, for example based on one of the sensors or if there is a discrepancy between the readings from the tower 102,103 and passenger carrier 104 proximity sensors or the like, the control system is switched to manual mode. In manual mode everything is under the control of an operator.

The amusement ride assembly 100 may be configured to provide a number of possible adventure or recreational rides for passengers ranging from a fast adrenaline ride to a slower scenic ride.

In an adrenalin ride for example, passengers are loaded onto the passenger carrier 104 at the drive tower 102. At the start of the ride the loaded passenger carrier 104 is released from the drive tower 102 and allowed to free-roll along the cable 101, accelerating under the influence of gravity, toward the return tower 103. After the passenger carrier 104 is released the control system actuates the drive system to rotate the cable 101 in the direction the passenger carrier 104 is traveling along the cable 101, for example the drive system may slowly accelerate the cable 101 up to a speed of 5 m/s. Wind resistance, equipment friction, and the cable 101 arc will slow the passenger carrier 104 as it nears the return tower 103. When the speed of the passenger carrier 104 slows to substantially the same speed as the cable 101, or another predetermined speed, the control system sends a control signal to the passenger carrier control module to close the clamp. This ensures that that the actuation of the clamp is not likely to jerk the passenger carrier 104. Once the clamp is fully closed the passenger carrier 104 is fixed to the moving cable 101 and is transported closer toward the return tower 103.

When the passenger carrier 104 is a certain distance from the return tower 103, for example 150 m as determined by the proximity sensors and/or distance measuring device, the control system initiates a controlled deceleration of the cable 101. The speed of the cable 101 is then progressively slowed so that the passenger carrier 104 is brought to a gradual halt approximately 50 m from the tower. The control system may then open the clamp, this time allowing the passenger carrier 104 to free-roll back along the cable 101 with the passengers' backs facing toward the direction of travel, under the influence of gravity, toward the drive tower 102. During this part of the ride the cable 101 is rotated in the opposite direction as it was previously, and as the passenger carrier 104 approaches the drive tower 102 the same clamping process as was utilised in the first part of the ride is initiated. This process may continue a number of times to provide the passengers with a number of gravity cable rides. At the end of the ride the clamp is closed and the cable 101 rotated to return the passenger carrier 104 to the drive tower 102 for unloading of passengers. It will be appreciated that the cable 101 does not have to be rotated while the passenger carrier 104 free-rolls along it.

In an alternative adrenalin ride, the passenger carrier 104 once loaded is released from the drive tower 102, and allowed to oscillate back and forth between the two towers 102, 103 on the cable 101 without actuation of the clamping mechanism 400. When the passenger carrier 104 comes to rest substantially in the middle of the cable 101, the clamping mechanism 400 is actuated and the cable 101 rotated to return the passenger carrier 104 to the drive tower 102 for unloading of passengers.

For a slower scenic ride, the amusement ride assembly 100 can be controlled to provide a chairlift type ride back and forth between the two towers 102, 103. For this ride, a loaded passenger carrier 104 is clamped to the loop cable 101, via the clamping mechanism 400, for the entire duration of the ride. The loaded passenger carrier 104 is transported from the drive tower 102 and across to the return tower 103 via the drive system which rotates the cable 101 and attached passenger carrier 104 in the appropriate direction. Once the passenger carrier 104 reaches the return tower 103, the drive system rotates the cable 101 in the reverse direction to return the passenger carrier 104 to the drive tower 102 for unloading of passengers.

Partial or controlled actuation of the clamping mechanism 400 can be utilised to provide a ride which is a compromise between the full adrenaline gravity ride and the slower scenic ride, in terms of speed. For example, the passenger carrier 104 could initially be clamped to the cable 101 and moved away from the drive tower 102 by movement of the cable. Once the passenger carrier 104 has been moved a predetermined distance away from the drive tower 102, the clamping mechanism 400 could be released thereby enabling the passenger carrier 104 to free roll towards the return tower 103. This would result in a shorter free-roll distance than the first described adrenalin ride, thereby resulting in a lower velocity of the passenger carrier 104. Alternative methods of providing various rides can be derived using the amusement ride assembly 100. For example, it will be appreciated that various rides could be provided which comprise a combination of the above mentioned rides or other alternatives which involve different free-rolling and clamping combinations.

The amusement ride assembly 100 may also be altered to include additional features. For example the passenger carrier 104 could include a swivel mechanism which is arranged to rotate the passenger carrier 104 360° about a substantially vertical axis. This swivel mechanism may also be controlled remotely, for example by the control system, via the passenger carrier control module. Alternatively, or additionally, manual actuation and control of the swivel mechanism may be provided for passengers in the form of a switch, dial, button, knob or the like located on a passenger control panel. It may be desirable for the passenger carrier to be rotatable about an angle of about 180°, so that the passenger carrier 104 can face in the direction of travel, i.e. the passenger carrier 13 may be rotated 180° after the first free-roll ride toward the return tower 103 is complete, ready for a second ride back toward and facing the drive tower 102. Further, it may be that the swivel mechanism could constantly rotate the passenger carrier 104 during the entire ride to increase the adrenaline rush.

To increase safety, the ride assembly 100 may be provided with a rescue carrier which may travel on the cable 101 to the passenger carrier 104 should it be stranded for some reason, for example due to failure of the clamping mechanism 400. The rescue carrier could be self powered or may simply free-roll along the cable 101 via a roller mechanism. The rescue carrier could be attached to a winching system at one of the towers 102, 103 to enable retrieval.

The ride assembly 100 can be adapted to accommodate two passenger carriers operating simultaneously on opposite sides of the loop cable 101. Loading and unloading capability at the return tower 103 would be enabled to allow for this. The passenger carrier's loading capacity can be adapted to accommodate for this alternative arrangement also. For example, one 4-person passenger carrier could operate solely, or two 2-person passenger carriers simultaneously. Alternatively, the cable 101 could be arranged to enable larger or smaller passenger carriers to be used as desired. The passenger carriers may also be fully enclosed and the passengers may be seated back to back.

It will be appreciated that the amusement ride assembly is scalable, so can be expanded or reduced in size or scale to suit requirements. The addition of further stations, bull wheels, and other drive systems is included within the scope of the invention. The cable length may be altered according to requirements and it is not necessary that the stations be at the same height.

Figure 8:
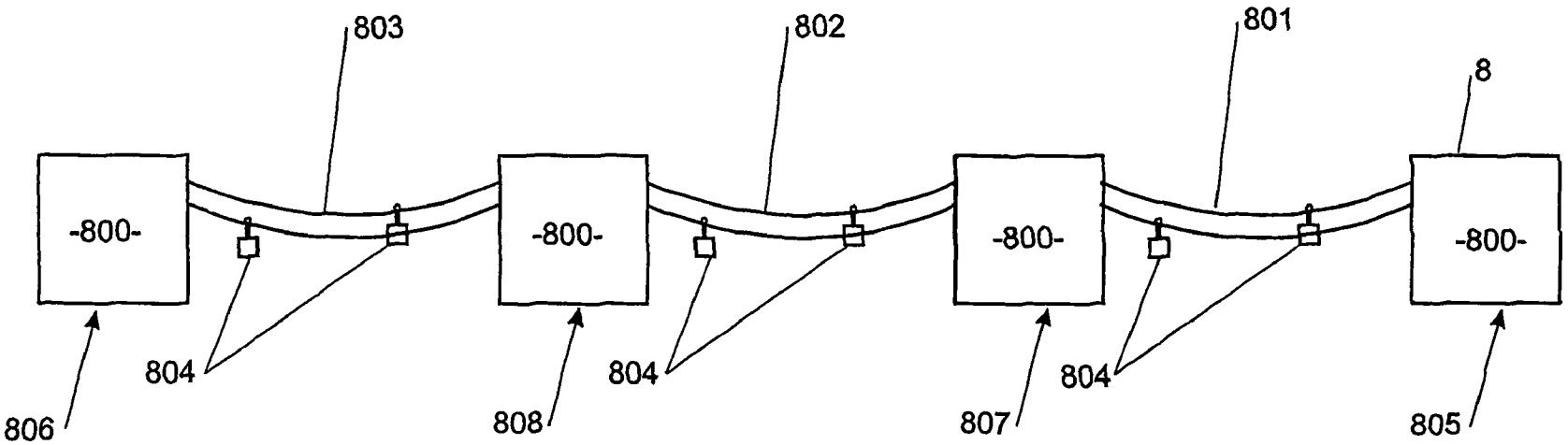
FIG. 8 shows a schematic diagram of an alternative amusement ride assembly arrangement with more than two stations.

Referring to FIG. 8, an alternative amusement ride assembly is shown comprising three cascaded stages, where each stage includes a rotatable endless loop cable 801, 802, 803 suspended between two stations 800. The arrangement also includes one or more passenger carriers 804 as described above riding on one or both sides of the cables 801, 802, 803. It will be appreciated that each station 800 may have a suitable drive system, for example drive bull wheels, to rotate the cables 801, 802, 803. The stations 800 may also have passenger loading/unloading capability. Further, each station 800 may have a transfer system which is arranged to transfer passenger carriers 804 between cables of adjacent stages so they can ride on each cable 801, 802, 803.

In an alternative arrangement, the cable sections 801, 802, 803 could be formed from one rotatable endless loop cable which is suspended between the end stations 805, 806 and is supported between these stations 805, 806 by intermediate stations 807, 808.

Figure 9:
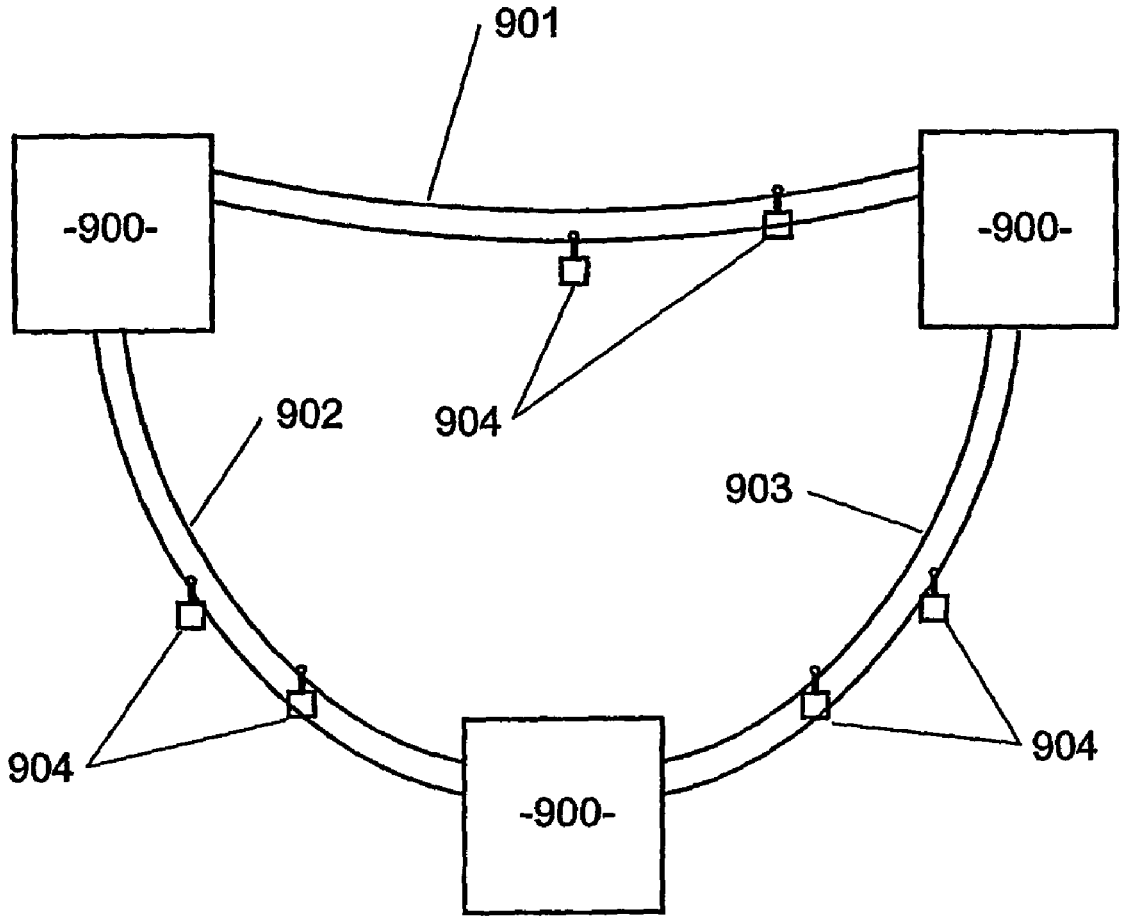
FIG. 9 shows another schematic diagram of an alternative amusement ride assembly which includes more than two stations.

Referring to FIG. 9, another alternative ride arrangement is shown, again comprising three stages, where each stage includes an endless rotatable loop cable 901, 902, 903 suspended between two stations 900 upon which one or more passenger carriers 904 ride. It will be appreciated that the cable sections 901, 902, 903 could be provided by one rotatable endless loop cable which is coupled to each of the stations 900 in an alternative arrangement.

It will be appreciated that the ride assembly 100 can be adapted for the transportation of heavy goods, such as tree-trunks, building material or the like in various locations, and would be provided with a goods carrier for this purpose.

The foregoing description of the invention includes preferred forms thereof. Modifications and alternatives as would be obvious to those skilled in the art are intended to be incorporated in the scope hereof as defined in the accompanying claims.

What we claim is:

1. An amusement ride assembly comprising:

a rotatable endless loop cable spanning with a catenary between end stations and the loop cable configured and operating in use as both a ride cable upon which a passenger carrier free-rolls under gravity and as a retrieval means for returning the passenger carrier to an end station after a ride via rotation of the loop cable;

a drive system operable by control signals to rotate the loop cable;

a passenger carrier suspended from the loop cable by a roller mechanism having roller wheels that are rotatably engaged with the loop cable to enable the passenger carrier to free-roll along the loop cable under gravity and the passenger carrier further comprising a clamping mechanism that is actuatable by control signals between a closed position in which the clamping mechanism is clamped to the loop cable to fix the passenger carrier to the loop cable and an open position in which the clamping mechanism is unclamped from the loop cable to allow the passenger carrier to free-roll along the loop cable under gravity via the roller mechanism; and an electronic control system that is in signal communication with the drive system and the clamping mechanism of the passenger carrier, and which is configured to send control signals to actuate the clamping mechanism into the open position during a ride to allow the passenger carrier to free-roll along the loop cable under gravity via the roller mechanism from or toward one of the end stations toward or from another of the end stations and to subsequently actuate the clamping mechanism into a closed position to fix the passenger carrier to the loop cable at a position between the end stations for retrieval of the fixed passenger carrier toward one of the end stations via rotation of the loop cable by the drive system, the electronic control system being configured to operate automatically according to preset programming or being manually operable by an operator remote from the passenger carrier.

2. An amusement ride assembly according to claim 1 wherein the electronic control system is programmed to actuate the clamping mechanism of the passenger carrier into the open position to allow the passenger carrier to free-roll part way along the loop cable after initial release of the passenger carrier and to then actuate the clamping mechanism into the closed position to fix the passenger carrier to the loop cable when the passenger carrier has slowed down to less than a predetermined speed.

3. An amusement ride assembly according claim 1 wherein the electronic control system is switchable between an automatic mode in which the electronic control system is configured to control movement of the passenger carrier along the loop cable via coordinated actuation of the clamping mechanism and operation of the drive system according to programmed ride settings, and a manual mode in which the electronic control system is manually operable by an operator remote from the passenger carrier to control movement of the passenger carrier along the loop cable via actuation of the clamping mechanism and operation of the drive system.

4. An amusement ride assembly according to claim 1 wherein the electronic control system comprises one or more sensors arranged to detect any one or more of the following: proximity of the passenger carrier to either of the end stations; actuation position of the clamping mechanism; speed of the passenger carrier along the loop cable; and distance traveled by the passenger carrier along the loop cable.

5. An amusement ride assembly according to claim 1 wherein the passenger carrier further comprises a swivel mechanism that is operable to rotate the passenger carrier about a substantially vertical axis.

6. An amusement ride assembly according to claim 1 wherein the drive system is operable to rotate the loop cable in either direction, and wherein the electronic control system is arranged to operate the drive system to rotate the loop cable in the same direction that the passenger carrier free-rolls along the loop cable, while the passenger carrier free-rolls along the loop cable.

7. An amusement ride assembly according to claim 6 wherein the electronic control system is arranged to actuate the clamping mechanism into the closed position to fix the passenger carrier to the loop cable when the passenger carrier has slowed down to a speed which is substantially the same as the speed of the loop cable.

8. An amusement ride assembly according to claim 1 comprising two passenger carriers, one carried on each side of the loop cable.

9. An amusement ride according to claim 1 further comprising one or more intermediate stations located between the end stations and which support the loop cable intermediate of its length.

10. A method of providing an amusement ride comprising the steps of:

(a) loading a passenger carrier with one or more passengers, the passenger carrier being suspended from a loop cable spanning with a catenary between end stations by a roller mechanism having roller wheels that are rotatably engaged with the loop cable to enable the passenger carrier to free-roll along the cable under gravity and the loop cable configured and operating in use as both a ride cable upon which a passenger carrier free-rolls under gravity and as a retrieval means for returning the passenger carrier to an end station after a ride via rotation of the loop cable, and the passenger carrier further comprising a clamping mechanism that is actuatable between a closed position in which the clamping mechanism is clamped to the loop cable to fix the passenger carrier to the loop cable and an open position in which the clamping mechanism is unclamped from the loop cable to allow the passenger carrier to free-roll along the loop cable under gravity via the roller mechanism;

(b) actuating the clamping mechanism of the passenger carrier into the open position to allow the passenger carrier to free-roll under gravity via the roller mechanism along a span of the loop cable from a position at or toward one end station, toward or from another of the end stations;

(c) actuating the clamping mechanism of the passenger carrier into the closed position to fix the passenger carrier to the loop cable at a position between the two end stations; and (d) rotating the loop cable to move the fixed passenger carrier toward either of the end stations.

11. A method according to claim 10 wherein step (c) further comprises the step of actuating the clamping mechanism of the passenger carrier into the closed position when the speed of the free-rolling passenger carrier drops below a predetermined speed relative to the cable.

12. A method according to claim 10 wherein step (b) further comprises the step of rotating the loop cable in the same direction of travel as the free-rolling passenger carrier.

13. A method according to claim 12 wherein step (c) comprises actuating the clamping mechanism of the passenger carrier into the closed position when the speed of the free-rolling passenger carrier is substantially the same as the speed of the cable.

14. An amusement ride assembly according to claim 1 further comprising one or more additional cascaded stages, each stage comprising:

a rotatable endless loop cable spanning with a catenary between two stations; and the loop cable configured and operating in use as both a ride cable upon which a passenger carrier free-rolls under gravity and as a retrieval means for returning the passenger carrier to an end station after a ride via rotation of the loop cable; and a drive system operable by control signals to rotate the loop cable; and one or more passenger carriers, each passenger carrier suspended from the loop cable by a roller mechanism having roller wheels that are rotatably engaged with the loop cable to enable the passenger carrier to free-roll along the loop cable under gravity via the roller mechanism and a clamping mechanism that is in signal communication with the electronic control system and which is actuatable by control signals from the electronic control system between a closed position in which the clamping mechanism is clamped to the loop cable to fix the passenger carrier to the loop cable and an open position in which the clamping mechanism is unclamped from the loop cable to allow the passenger carrier to free-roll along the loop cable under gravity via the roller mechanism.

15. An amusement ride assembly according to claim 14 wherein the passenger carrier(s) may transfer between loop cables of adjacent stages, and wherein a transfer station is provided between each stage to facilitate the transfer of the passenger carrier(s) between loop cables of adjacent stages.

16. An amusement ride assembly according to claim 15, wherein one or more of the stations may form part of an adjacent stage.

17. An amusement ride assembly comprising:

a rotatable endless loop cable spanning with a catenary between end stations and the loop cable configured and operating in use as both a ride cable upon which a passenger carrier free-rolls under gravity and as a retrieval means for returning the passenger carrier to an end station after a ride via rotation of the loop cable;

a drive system operable by control signals to rotate the loop cable;

a passenger carrier suspended from the loop cable by a roller mechanism having roller wheels that are rotatably engaged with the loop cable to enable the passenger carrier to free-roll along the loop cable under gravity and the passenger carrier further comprising a clamping mechanism that is actuatable by control signals between a closed position in which the clamping mechanism is clamped to the loop cable to fix the passenger carrier to the loop cable and an open position in which the clamping mechanism is unclamped from the loop cable to allow the passenger carrier to free-roll along the loop cable under gravity via the roller mechanism; and an electronic control system that is in signal communication with the drive system and the clamping mechanism of the passenger carrier, and which is programmed to automatically send control signals to actuate the clamping mechanism into the open position during a ride to allow the passenger carrier to free-roll part way along the loop cable under gravity via the roller mechanism from or toward one of the end stations and to then actuate the clamping mechanism into the closed position to fix the passenger carrier to the loop cable when the passenger carrier has slowed down to less than a predetermined speed.

18. An amusement ride assembly comprising:

a rotatable endless loop cable spanning with a catenary between end stations and the loop cable configured and operating in use as both a ride cable upon which a passenger carrier free-rolls under gravity and as a retrieval means for returning the passenger carrier to an end station after a ride via rotation of the loop cable;

a drive system operable by control signals to rotate the loop cable;

a passenger carrier suspended from the loop cable by a roller mechanism having roller wheels that are rotatably engaged with the loop cable to enable the passenger carrier to free-roll along the loop cable under gravity and the passenger carrier further comprising a clamping mechanism that is actuatable by control signals between a closed position in which the clamping mechanism is clamped to the loop cable to fix the passenger carrier to the loop cable and an open position in which the clamping mechanism is unclamped from the loop cable to allow the passenger carrier to free-roll along the loop cable under gravity via the roller mechanism; and an electronic control system that is in signal communication with the drive system and the clamping mechanism of the passenger carrier, and which is configured to be manually operable by an operator remote to the passenger carrier to send control signals to actuate the clamping mechanism into an open position during a ride to allow the passenger carrier to free-roll part way along the loop cable under gravity via the roller mechanism from or toward one of the end stations and to then actuate the clamping mechanism into the closed position to fix the passenger carrier to the loop cable when the passenger carrier has slowed down to less than a predetermined speed.

19. An amusement ride assembly according to claim 3 wherein the electronic control system is arranged to switch from the automatic mode to the manual mode on detection of a fault.

20. An amusement ride assembly according to claim 1 wherein the electronic control system comprises a control module at each end station, and wherein the control modules are arranged to communicate via a radio link.

21. An amusement ride assembly according to claim 20 wherein the electronic control system further comprises a passenger carrier control module located on the passenger carrier that is arranged to generate control signals for actuating the clamping mechanism, and wherein the passenger carrier control module further comprises a radio transmitter/receiver for communicating with at least one end station control module and is arranged to actuate the clamping mechanism in response to signals received from an end station control module.

22. An amusement ride assembly according to claim 1 wherein the control system comprises a passenger carrier control module located on the passenger carrier that is arranged to generate control signals for actuating the clamping mechanism based on preset programming of the passenger carrier control module.

23. An amusement ride assembly according to claim 1 wherein the clamping mechanism comprises: two opposing rope clamp blocks being located on opposite sides of the loop cable and which are movably mounted for reciprocating movement toward or away from each other, the rope clamp blocks being operatively connected to an actuator that is configured to drive movement of the clamping mechanism based on control signals between the open position in which the rope clamp blocks are displaced from the cable allowing it to freely travel through the clamping mechanism and the closed position in which the rope clamp blocks are engaged with the cable to fix it within the clamping mechanism.

* * * * *